US005271917A

United States Patent [19]

Hoffman

[11] Patent Number: 5,271,917

[45] Date of Patent: Dec. 21, 1993

[54] ACTIVATION OF CARBON FIBER SURFACES BY MEANS OF CATALYTIC OXIDATION

[75] Inventor: Wesley P. Hoffman, Lancaster, Calif.

[73] Assignee: The United States of America as represented by the Secretary of the Air Force, Washington, D.C.

[21] Appl. No.: 951,375

[22] Filed: Sep. 25, 1992

Related U.S. Application Data

[63] Continuation of Ser. No. 407,594, Sep. 15, 1989, abandoned.

[51] Int. Cl.[5] ..... D01F 11/12

[52] U.S. Cl. ..... 423/447.6; 427/113; 427/226; 502/423; 502/424; 429/44

[58] Field of Search ..... 423/447.1, 447.6, 447.7, 423/460; 427/113, 226; 502/423, 424; 429/44

[56] References Cited

U.S. PATENT DOCUMENTS

| | | | |
|---|---|---|---|
| 3,476,703 | 11/1969 | Wadsworth et al. | 260/37 |
| 3,495,940 | 2/1970 | Stuetz | 423/447.7 |
| 3,657,082 | 4/1972 | Wells et al. | 204/130 |
| 3,720,536 | 3/1973 | Scola et al. | 117/47 R |
| 3,746,560 | 7/1973 | Goan et al. | 106/307 |
| 3,762,954 | 10/1973 | Metcalfe, III et al. | 423/460 |
| 3,989,802 | 11/1976 | Joo et al. | 423/447.1 |
| 4,009,305 | 2/1977 | Fujimaki et al. | 427/399 |
| 4,374,114 | 2/1983 | Kim et al. | 423/447.1 |
| 4,490,201 | 12/1984 | Leeds | 156/155 |
| 4,935,265 | 6/1990 | Pike | 427/226 |

FOREIGN PATENT DOCUMENTS

| | | | |
|---|---|---|---|
| 55-3347 | 1/1980 | Japan | 423/460 |

OTHER PUBLICATIONS

Baker, *Chemistry & Industry* Sep. 18, 1982 pp. 698–702.

*Primary Examiner*—Gregory A. Heller
*Assistant Examiner*—Stuart L. Hendrickson
*Attorney, Agent, or Firm*—Stanton E. Collier; Donald J. Singer

[57] ABSTRACT

Carbon fibers having substantially increased active surface area and total surface area are used to enhance carbon fiber bonding to matrix materials in carbon fiber products. The enhanced active surface area and total surface area are produced by carbon removal in disordered regions as well as perfect basal plane regions by catalytic silver oxidation.

6 Claims, 3 Drawing Sheets

OXIDATION IN AIR AT 500°C

ARGON PLASMA

OXYGEN PLASMA

SILVER OXIDATION

ACTIVATION OF CARBON FIBER SURFACES BY MEANS OF CATALYTIC OXIDATION

STATEMENT OF GOVERNMENT INTEREST

The invention described herein may be manufactured and used by or for the Government for governmental purposes without the payment of any royalty thereon.

This application is a continuation of application Ser. No. 07/407,594, filed Sep. 15, 1989, now abandoned.

BACKGROUND OF THE INVENTION

This invention relates to treatment of carbon fibers and, in particular, to the treatment of the surface of carbon fibers in order to increase the active surface area, total surface area, and surface roughness of these fibers.

Carbon fibers because of their unique combination of properties are finding increased use in fields as diverse as energy, sporting goods and aerospace. Because of their relative chemical inertness, they are finding use as a catalyst support in fuel cells and in numerous other chemical reactions. In a structural composite the fiber properties that are most useful are their high strength, high modulus, and low density. At elevated temperatures these fibers become even more attractive in structural composites because they have very significant strength and modulus up to 3000° C. Thus, it is the matrix material and not the fiber that determines the composites useful temperature envelope. For applications up to about 300° C. the matrix is usually an epoxy or a phenolic, while at higher temperatures a metal matrix can be used. At temperatures above 1200° C. the matrix must be a ceramic or carbon itself. These carbon-carbon composites are very useful materials that have found wide application because they are stronger and stiffer than steel, have a lower density, and maintain their properties to very high temperatures.

Carbon fiber composites can be tailored to have a wide range of properties. Apart from using different carbon fibers this can be accomplished by modifying (1) the fiber architecture, (2) the matrix material, or (3) the degree of fiber-matrix bonding. It is possible to modify the fiber-matrix interface by changing the fiber's surface roughness, or the degree of chemical interaction between the fiber and the matrix.

The degree of chemical interaction between the fiber and the matrix, which is the most important of these three parameters, can be enhanced in order to increase the tensile strength of the composites. This results in a decreased failure rate due to fiber pull-out under tensile stress.

This enhancement in chemical bonding can be accomplished by increasing the fiber's active surface area (ASA) which is composed of all the sites on a carbon fiber surface capable of forming a chemical bond. These sites are located on the carbon surface wherever the valence is not satisfied. Typically, the majority of these sites are located at the edges of the basal planes but active sites are also located at any imperfection in the basal plane such as vacancies, dislocations, interstitials, etc.

It is the ASA that also acts as bonding sites for metal particles placed on the carbon fiber surface to serve as catalysts. Carbon fibers as a catalyst support find application in numerous chemical reactions such as in fuel cells, heterogeneous reactions, and as electrodes in electrochemical processes. Carbon fibers in these applications improve mechanical properties and give better thermal shock resistance. For this reason, it is desirable to significantly enhance the size and number of ASA patches on a carbon fiber surface used as a catalyst support. This ASA enhancement would increase both the amount of catalyst that could be placed on the surface and its degree of dispersion. Both of these parameters have a significant effect on the efficiency of the supported catalyst.

Further, the carbon active sites also serve as nucleation sites for any deposit or coating. In many cases, such as for oxidation protection, it is desirable to coat carbon fibers or composites made from them. To accomplish this it is necessary to have a significant number of ASA patches with a certain minimum size in order to bond coatings, which are composed of molecules much larger than an oxygen molecule, to the fiber surface.

Traditional manufacturing process to increase the number of carbon fiber active sites include oxidation in air, nitric acid, or an electrochemical cell. The limitation of all these techniques is that they only increase the size of ASA patches already present on the surface but are unable to create ASA patches in the perfect basal plane areas.

On the other hand, alternate techniques such as plasma etching in argon or oxidation in atomic oxygen, in addition to removing edge sites are able to remove basal plane atoms and create ASA patches where none existed previously. However, even these process are not as effective in increasing the fiber active surface area as catalytic oxidation. Some of these prior process are disclosed in the following U.S. Patents which are incorporated by reference:

| | |
|---|---|
| 3,476,703 | 3,989,802 |
| 3.657,802 | 4,009,305 |
| 3,720,536 | 4,374,114 |
| 3,746,560 | 4,490,201 |

SUMMARY OF THE INVENTION

The invention comprises a process to significantly increase both the active surface area and total surface area of carbon fibers with negligible weight-loss while at the same time creating active surface areas where none previously existed.

In order to increase both the active surface area and the total surface area, a metallic or metal oxide coating, capable of catalyzing carbon gasification, is, firstly, applied to the carbon fibers.

If the coating is applied from the liquid or solid phase, the fibers are then washed in distilled water and dried. The coated fibers are then heated from room temperature up to the gasification temperature in a reactive atmosphere at a rate that is less than 10° C./sec. The fibers are then gasified using oxygen, hydrogen, carbon dioxide or air to the desired level of weight-loss which is kept to a minimum. The fibers are then cooled to a room temperature. At this time the coating is removed and the fibers are ready for use.

In a preferred embodiment of the present invention the coating is metallic silver that has been deposited from solution. The silver coated fibers are heated from room temperature to about 500° C. at 20° C./min in flowing air and oxidized until the desired active surface area increase is obtained. However, if other metals are used the temperature might be higher. The metal coating is removed by means of a dissolving acid which is incapable of dissolving the carbon fiber.

It is therefore one object of the present invention to provide a process of increasing carbon fiber's total and active surface area in order to improve the degree of fiber-matrix bonding.

Another object of the present invention is to provide a process of increasing the fiber's total and active surface area in order to improve the degree of bonding between a carbon fiber composite and a coating.

Another object of the present invention is to provide a process of creating active sites in perfect basal plane regions so that fiber-matrix bonding can occur where none existed previously.

Another object of the present invention is to provide a process of creating active sites in perfect basal plane regions so that the amount of catalyst and its degree of dispersion on a carbon fiber surface can be increased.

Another object of the present invention is to provide a process of enlarging active surface area patches so that other matrix and coating materials not currently used because of insufficient bonding area can be employed in the manufacture of composites made from carbon fibers.

Another object of the present invention is to provide a process of increasing both active sites and surface area to enhance fiber-matrix bonding, mechanical properties of composites of such, and to increase the amount of catalyst loading and its dispersion when carbon fibers are used as a catalyst support.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

The present invention provides a process to create new active sites on carbon fiber surfaces substantially increasing both the active and the total surface area of the carbon fiber with less than 1% weight-loss during the process. Weight-loss must be minimized so that the fiber's excellent mechanical properties are not degraded.

Figure 1A:
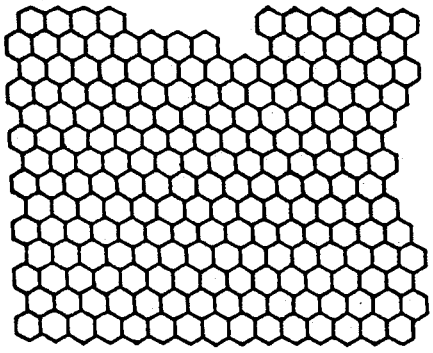
FIGS. 1A, 1B, 1C and 1D schemately illustrate the results of different processes carbon removal types created by different means of oxidation of carbon fiber.
Figure 1B:
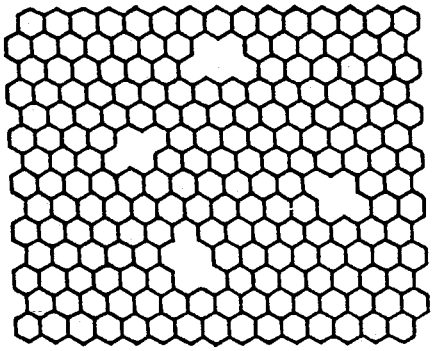
Figure 1C:
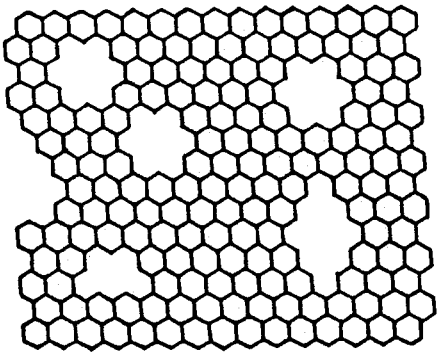
Figure 1D:
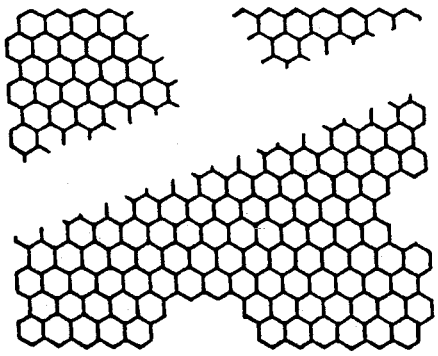

The active sites are created by catalytic gasification where a metal or metal oxide is used as a catalyst during the gasification of carbon. After gasification the metal or metal oxides may be removed and reclaimed. Any metal or metal oxide that forms pits or channels in the carbon surface during oxidation may be used. Channeling catalysts are preferred because pitting catalysts usually do not gasify as quickly and result in pits that can go through the fiber and degrade the mechanical properties. A solution to this problem is to use pitting catalysts during a mild gasification and then remove it. After this step, a channeling catalyst is deposited on the pitted surface and gasification is restarted. FIG. 1 illustrates the pitting and channeling in carbon fibers, and in particular, FIG. 1D, schematically illustrates that catalytic silver oxidation forms channels in a perfect basal plane region.

In general any metal or its oxide that forms pits or channels in the carbon fiber surface can be used to oxidize the carbon fiber surface. These metals would include the transition metal, its oxide, or combinations from the following list:

| | | |
|---|---|---|
| platinum | nickel | iridium |
| rhenium | vanadium | lead |
| tungsten | palladium | cobalt |
| iron | molybdenum | copper |
| cadmium | chromium | manganese |
| ruthenium | silver | gold |

Figure 2:
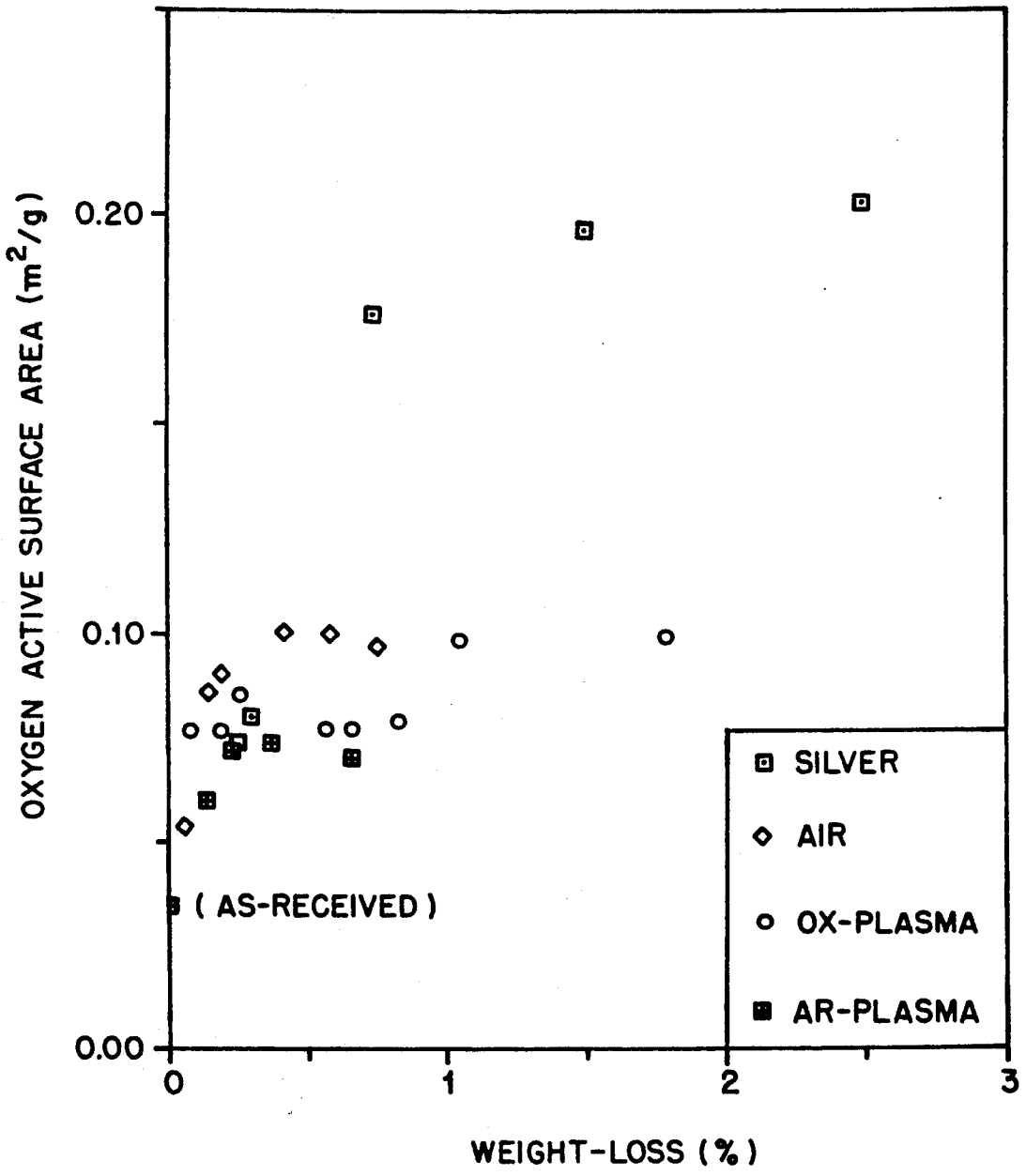
FIG. 2 illustrates the increase in the active surface area (ASA) by the present invention.
Figure 3:
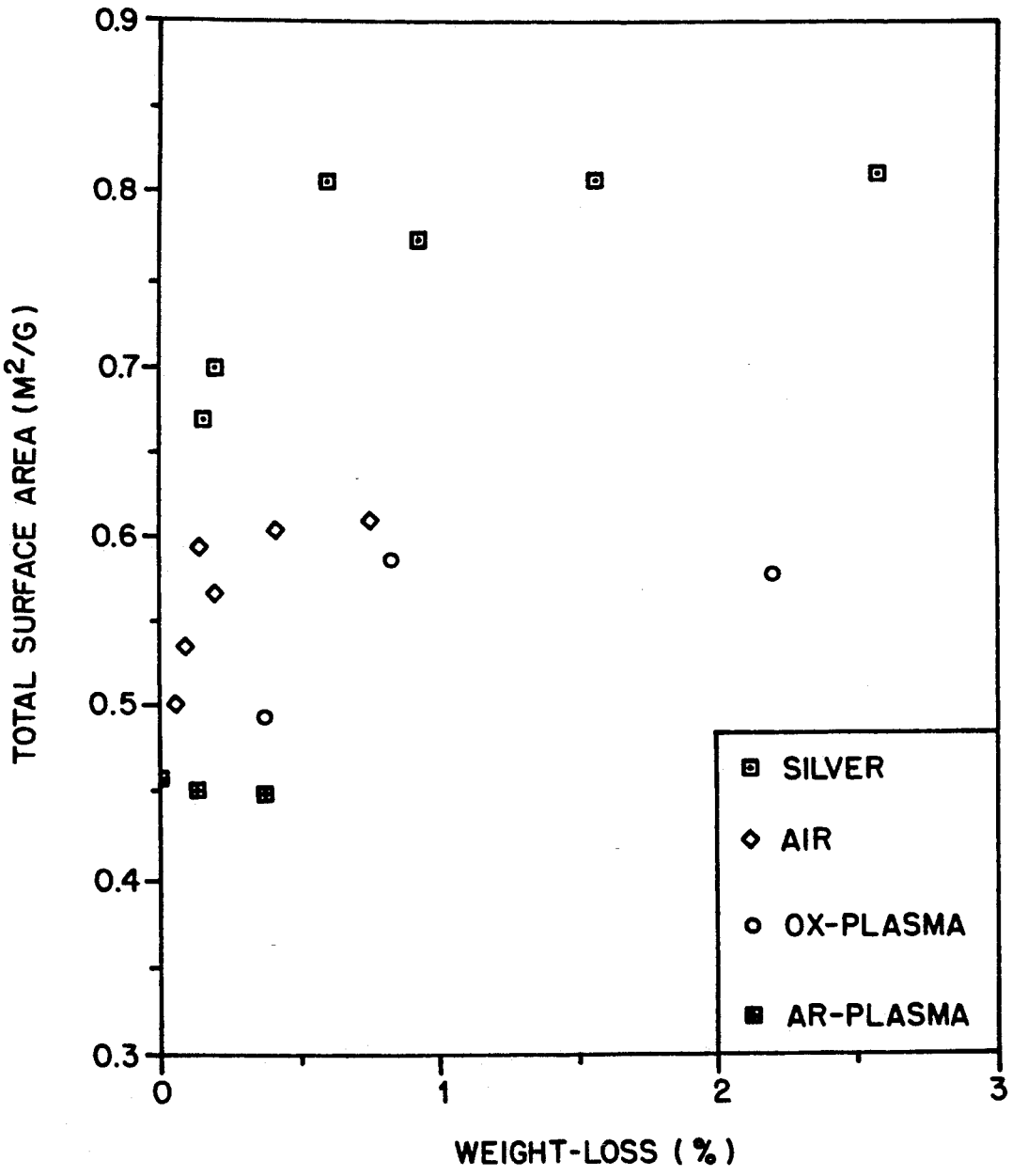
FIG. 3 illustrates the increase the in the total surface area by the present invention.

In reference to FIGS. 2 and 3, it is seen that silver, for example, used in the catalytic gasification, provided an almost three fold increase in the active surface area with only about 1% fiber burn-off.

The invention further provided approximately a 30% increase in the total surface area.

Silver may also be used for catalytic gasification of carbon fibers used in carbon-carbon composites because of the compensation effect. That is, above 1000° C. silver actually inhibits the oxidation of carbon. Thus, even if traces of silver remained on the surface, the silver would act as an inhibitor toward gasification at high temperature where these composites find application.

The metal or its oxide can be applied to the fiber surface from a solid, liquid or gaseous source such as deposition from solution, chemical vapor deposition, sputtering, electrodeposition, electrophoresis, sol-gel, pack cementation, or plasma deposition. Depending upon the process of deposition of the metal, or its oxide, the fiber surface may have to be cleaned prior to deposition. Once the metal or its oxide is on the surface, the fiber is heated in a reactive atmosphere at a rate less than 10° C./sec to a temperature at which the metal starts to move on the surface.

The temperature at which the metal commences movement, i.e. becomes mobile, and catalytic channeling or pitting starts is equal to about the half the bulk melting point of the metal. The catalytic gasification occurs at or above this temperature. In practice the temperature is held constant at or less than 200° C. above the temperature at which mobility commences. If the temperature is raised too high, the catalyst can lose its activity. Gasification is terminated when the desired weight-loss is reached. The sample is then cooled and the catalyst is removed. The most convenient way to remove the catalyst is by treatment in an acid solution, but any process that does not degrade the carbon fiber can be used. The metal can then be reclaimed from the acid solution if desired. Once the catalyst has been removed the sample is washed in distilled water and dried.

It has been determined that the initial metal loading on an untreated carbon fiber was low because of the small active surface area. As the silver channeled across the surface it was depleted and catalytic oxidation stopped. To restart the catalytic oxidation, it was necessary to recoat the carbon fibers with metal. The metal loading on the second cycle was substantially higher than on the first cycle. Thus, for some applications a second coating is necessary to either further increase the fiber active surface area by catalytic gasification or to coat the fiber for other applications such as a catalyst support for heterogeneous reactions as well as electrodes for fuel cells or other electrochemical cells.

Although the carbon can be removed by gasification as noted above, the carbon may be removed in an electrochemical cell being a liquid environment. The reactive environment may be a gaseous atmosphere or plasma such as oxygen, hydrogen, carbon dioxide or air.

After this step, the activated fibers can be made into a final product or can undergo further processing. An example of further processing would be additional activation by catalytic gasification or by using another technique, such as oxidation in air, atomic oxygen, nitric acid, an electrochemical cell, etc.

EXAMPLE

Unsized P-55 graphitized pitch fiber samples were subjected to various surface treatments. These included treatment in atomic oxygen and argon plasma using a Branson/PCS 3000 Plasma System as well as air oxidation of as-received and silver-coated samples at temperatures between 450° and 550° C. Although nitric acid worked well with an ungraphitized PAN (T-300) fiber, treatment of the graphitized fibers in nitric acid was not very sucessful and was not continued.

To place silver on the fiber surface, the sample was stirred in a silver diammine solution for 24 hours at room temperature. The sample was then washed in distilled water, dried, and oxidized in air in the temperature range between 450° C. and 550° C. Subsequent to the oxidation, the silver was removed in 1N nitric acid which was kept at 50° C. overnight. The sample was then washed in distilled water and dried.

After each surface treatment was completed, the active and total surface areas were measured. measured. The oxygen active surface area ($ASA_{o2}$) was measured by oxygen chemisorption at 300° C. The total surface area was measured by krypton adsorption at −195° C.

From FIG. 2, it is apparent that all the surface treatments increased the oxygen active surface area of the fiber (from 0.0342/$m^2$g) with only a 1.5% loss in weight. It is also evident that catalytic oxidation using silver was the most efficient technique. With this technique the ASA was augmented to a value twice as great as that obtained by the other process at the same weight loss.

The data presented in FIG. 3 show that catalytic silver oxidation was also the most efficient technique attempted to increase the total surface area of the fiber (from 0.458 $m^2$/g) while keeping the weight loss less than 2%.

Clearly, many modifications and variations of the present invention are possible in light of the above teachings and it is therefore understood, that within the inventive scope of the inventive concept, the invention may be practiced otherwise than specifically claimed.

What is claimed is:

1. A process for treating carbon fiber surfaces which increases the surface area with a total weight loss of less than 2%, comprising the steps of depositing onto the carbon fiber surface a single coating capable of catalyzing carbon gasification and in an amount to cause either pitting or channeling upon heating in air, said coating selected from the oxides or metals of the group consisting of Pt, Ni, Ir, Re, V, Pb, W, Pd, Co, Fe, Mo, Cu, Cd, Cr, Mn, Ru, Ag, Au, and mixtures thereof; applying air to the carbon fiber surface while heating the surface to a temperature at which the coating promotes localized oxidation to cause pitting or channeling and heating to increase the surface area, removing substantially all of said coating remaining after heating and cooling the carbon fiber.

2. A process as defined in claim 1, said process further including the step of cleaning the fiber surface before deposition.

3. A process as defined in claim 1 further including repeating at least once the same steps to additionally increase the total surface area.

4. A process as defined in claim 1 wherein said metal is silver.

5. A process as defined in claim 1 wherein said heating is at a rate less than about 10° C./second.

6. A process as defined in claim 5, wherein the coating is Ag and the temperature is 450° C. to 550° C.

* * * * *